US007207374B2

(12) United States Patent
Persky et al.

(10) Patent No.: US 7,207,374 B2
(45) Date of Patent: Apr. 24, 2007

(54) NON-OXIDIZABLE COATING

(75) Inventors: Joshua E. Persky, Carbondale, CO (US); Joseph J. Parkos, Jr., East Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/973,762

(22) Filed: Oct. 26, 2004

(65) Prior Publication Data

US 2006/0086478 A1 Apr. 27, 2006

(51) Int. Cl.
*B22C 9/10* (2006.01)

(52) U.S. Cl. ..... 164/369; 164/370

(58) Field of Classification Search ..... 164/24, 164/28, 30, 31, 32, 228, 302, 369, 370
See application file for complete search history.

(56) References Cited

U.S. PATENT DOCUMENTS

| | | | | |
|---|---|---|---|---|
| 2,682,101 | A * | 6/1954 | Whitfield et al. | 428/651 |
| 3,634,208 | A | 1/1972 | Kuroda | |
| 4,357,382 | A | 11/1982 | Lambert et al. | |
| 4,537,382 | A | 8/1985 | Beck | |
| 4,911,795 | A | 3/1990 | Olliff, Jr. | |
| 5,035,957 | A * | 7/1991 | Bartlett et al. | 428/552 |
| 5,104,514 | A | 4/1992 | Quartarone | |
| 5,135,801 | A | 8/1992 | Nystrom et al. | |
| 5,250,367 | A | 10/1993 | Santhanam et al. | |
| 5,616,229 | A | 4/1997 | Samsonov et al. | |
| 5,652,045 | A | 7/1997 | Nakamura et al. | |
| 5,928,771 | A | 7/1999 | DeWald, Jr. et al. | |
| 6,096,436 | A | 8/2000 | Inspektor | |
| 6,197,178 | B1 | 3/2001 | Patel et al. | |
| 6,365,028 | B1 | 4/2002 | Shatrov | |
| 6,637,500 | B2 | 10/2003 | Shah et al. | |
| 6,668,906 | B2 * | 12/2003 | Burd | 164/302 |
| 6,849,328 | B1 | 2/2005 | Marietti et al. | |
| 2001/0026840 | A1 | 10/2001 | Ozmat et al. | |
| 2001/0046605 | A1 | 11/2001 | Huni et al. | |

FOREIGN PATENT DOCUMENTS

GB 2061324 A 5/1981

OTHER PUBLICATIONS

European Search Report for EP Patent Application No. 05255510.9.

* cited by examiner

*Primary Examiner*—Kevin Kerns
*Assistant Examiner*—I.-H. Lin
(74) *Attorney, Agent, or Firm*—Bachman & LaPointe, P.C.

(57) ABSTRACT

A substrate is coated by applying a first layer atop the substrate and comprising, in major weight part, a non-refractory first metal. A second layer is applied atop the first layer and comprises, in major weight part, a carbide and/or nitride of a second metal. A third layer is applied atop the second layer and comprises, in major weight part, a ceramic. The substrate may be a refractory metal-based investment casting core.

6 Claims, 2 Drawing Sheets

NON-OXIDIZABLE COATING

BACKGROUND OF THE INVENTION

The invention relates to metallic coating. More particularly, the invention relates to protective coating of oxidizable investment casting cores.

Investment casting is a commonly used technique for forming metallic components having complex geometries, especially hollow components, and is used in the fabrication of superalloy gas turbine engine components.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades and vanes. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in well known fashion. The wax may be removed such as by melting in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and treated in one or more stages.

The ceramic cores themselves may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned co-pending U.S. Pat. No. 6,637,500 of Shah et al. discloses general use of refractory metal cores in investment casting among other things. Various refractory metals, however, tend to oxidize at higher temperatures, e.g., in the vicinity of the temperatures used to fire the shell and the temperatures of the molten superalloys. Thus, the shell firing may substantially degrade the refractory metal cores and, thereby produce potentially unsatisfactory part internal features. Also, the refractory metals may be subject to attack from components of the molten superalloys. Use of protective coatings on refractory metal core substrates may be necessary to protect the substrates from oxidation at high temperatures and/or chemical interaction with the superalloy. An exemplary coating involves first applying a layer of chromium to the substrate and then applying a layer of aluminum oxide to the chromium layer (e.g., by chemical vapor deposition (CVD) techniques). However, particular environmental/toxicity concerns attend the use of chromium. Accordingly, there remains room for further improvement in such coatings and their application techniques.

SUMMARY OF THE INVENTION

One aspect of the invention involves an investment casting core comprising a coated refractory metal based substrate. A first coating layer consists principally (e.g., in major weight part) of a ceramic. A second coating layer is located between the first layer and the substrate and consists principally of one or more carbides and/or nitrides There is at least one of: a third layer located between the second layer and the substrate and consisting in major part of one or more additional metals having an FCC lattice structure; and a solid solution surface layer of the substrate having a minor amount of said one or more additional metals.

In various implementations, the ceramic may consist essentially of at least one of alumina, mullite, magnesia, and silica. The substrate may be molybdenum-based. There may be no such third layer. The one or more additional metals may consist essentially of nickel. The first layer may consists essentially of aluminum oxide and the first thickness is a nominal (e.g., median) first thickness. At a first location: the first layer may have a first thickness is at least 4.0μ; the second layer may have a second thickness of 1.0 4.0μ; and the substrate may have a thickness in excess of 50μ. The core may be a first core in combination with: a ceramic or refractory metal second core; and a hydrocarbon-based material in which the first core and the second core are at least partially embedded.

Another aspect of the invention involves an article of manufacture comprising a refractory metal-based substrate. A first means provides a barrier. A second means, located between the first means and the substrate, secures the first means and contains one or more carbides and/or nitrides. A third means, located between the second means and the substrate, essentially prevents infiltration of at least one of carbon and nitrogen from the second means into the substrate. In various implementations, the first means may be ceramic, the second means may be a carbide, and the third means may be an fcc material.

Another aspect of the invention involves a method for coating a substrate. A first layer is applied atop the substrate and comprises, in major weight part, a non-refractory first metal. A second layer is applied atop the first layer and comprises in major weight part a carbide and/or nitride of a second metal. A third layer is applied atop the second layer and comprises, in major weight part, a ceramic.

In various implementations, the first metal may be essentially diffused into the substrate, at least a major portion of which occurs during one or both of the applying of the second layer and the applying of the third layer. The ceramic may consist essentially of an oxide of a third metal. The substrate may comprise, in major weight part, one or more refractory metals. The first layer may be deposited directly atop the substrate. The second layer may be deposited directly atop the first layer. The third layer may be deposited directly atop the second layer. The first metal may form an FCC lattice structure. The second metal may be titanium.

The ceramic may consist essentially of at least one of alumina, mullite, magnesia, and silica. The first layer may be deposited by electroplating. The second and third layers may be deposited by vapor deposition. The first layer may be deposited to a first thickness of at least 1μ (e.g., 1–3μ). The second layer may be deposited to a second thickness of least 0.5μ (e.g., 1–3μ). The third layer may be deposited to a third thickness of least 5μ (e.g., 15–25μ). The substrate may consist essentially of a molybdenum-based material. The method may be used to form an investment casting core component. The method may further comprise: at least one of assembling the core with a second core and forming a second core partially over the core; molding a sacrificial material to the core and the second core; applying a shell to the sacrificial material; essentially removing the sacrificial material; casting a metallic material at least partially in place of the sacrificial material; and destructively removing the core, the second core, and the shell. The destructively removing may comprise essentially removing at least the first layer and the second layer using $HNO_3$.

Another aspect of the invention involves a method for coating a substrate. There is a step for applying a first layer for essentially preventing carbon infiltration into the substrate. There is a step for applying a carbon-containing second layer for adherence with a third layer. There is a step for applying the third layer as a barrier.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
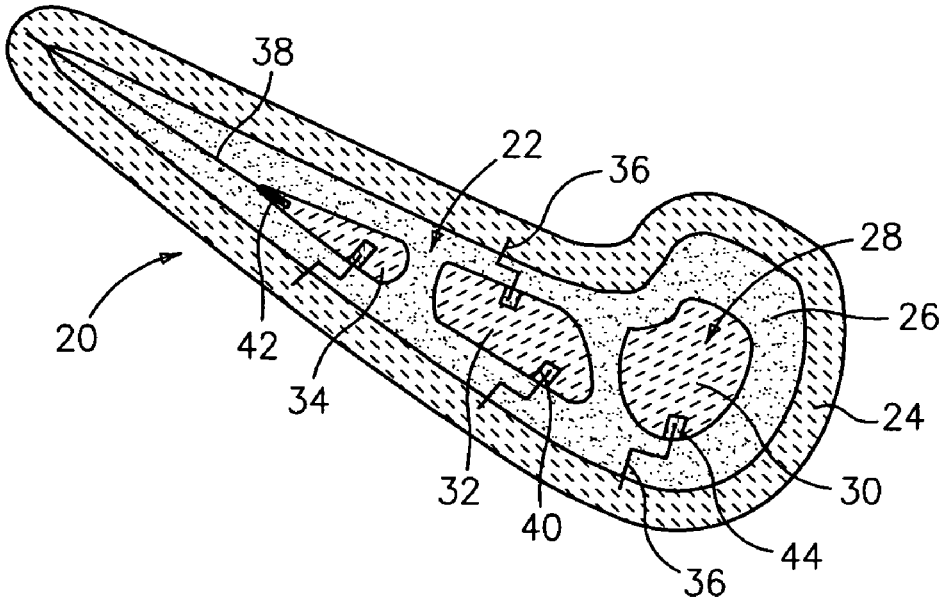
FIG. 1 is a cross-sectional view of a shelled investment casting pattern for forming a gas turbine engine airfoil element.

FIG. 1 shows a shelled investment casting pattern 20 including a pattern 22 and a ceramic shell 24. The pattern 22 includes a sacrificial wax-like material 26 (e.g., natural or synthetic wax or other hydrocarbon-based material) at least partially molded over a core assembly. The core assembly includes a ceramic feed core 28 having a series of generally parallel legs 30, 32, and 34 for forming a series of generally parallel, spanwise-extending, feed passageways in the ultimate part being cast (e.g., a gas turbine engine turbine blade, or vane). Assembled to the feed core 28 are a series of refractory metal cores (RMCs) 36 and 38. Portions of the RMCs 36 and 38 may be received in compartments 40 and 42 in the feed core 28 and secured therein via ceramic adhesive 44. Other portions of the RMCs 36 and 38 may be embedded in the shell 24 so that the RMCs 36 and 38 ultimately form outlet passageways from the feed passageways to the exterior surface of the part. The exemplary RMCs 36 provide film cooling passageways for airfoil pressure and suction side surfaces and the exemplary RMC 38 provides airfoil trailing edge cooling. Many other configurations are possible either in the prior art or yet to be developed.

Figure 2:
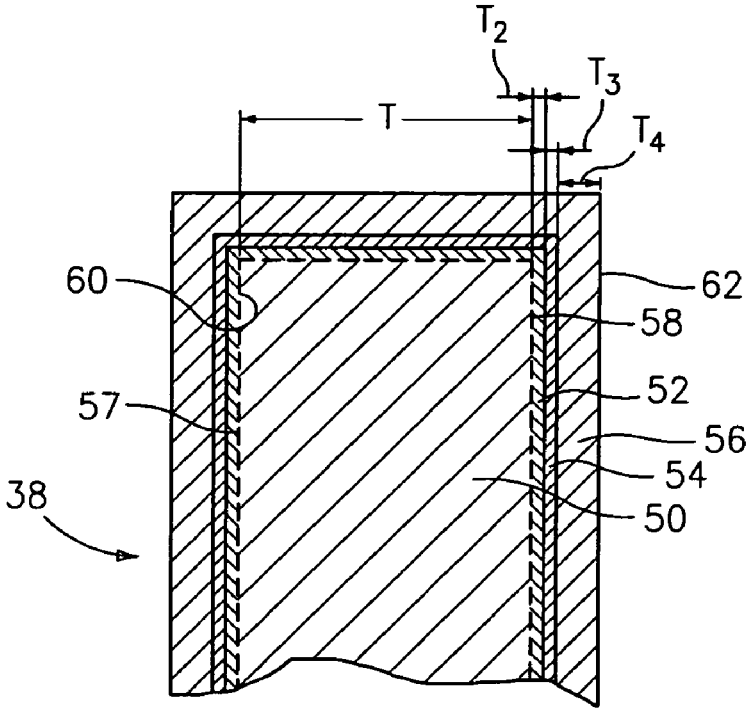
FIG. 2 is a sectional view of a refractory metal core of the pattern of FIG. 1.

FIG. 2 shows further details of one of the RMCs (e.g., 38). The exemplary RMC 38 has a substrate 50 of refractory metal or a refractory metal-based alloy, intermetallic, or other material. Exemplary refractory metals are Mo, Nb, Ta, and W. These may be obtained as wire or sheet stock and cut and shaped as appropriate. A coating system includes a base layer 52 initially deposited atop the substrate. Although shown discretely for purposes of illustration, in an exemplary embodiment the base layer material becomes diffused into the substrate material. An intermediate layer 54 is atop the base layer and an outer layer 56 is atop the intermediate layer.

The exemplary outer (and outermost) layer 56 may provide a combination of chemical protection, mechanical protection, and thermal insulation, (e.g., acting as a substantial barrier to infiltration of casting metal that might alloy with or otherwise attack the substrate and to oxygen to prevent oxidation). Exemplary outer layer materials are ceramics(e.g., aluminum oxide (alumina), mullite, silicon dioxide (silica), and magnesium oxide (magnesia)) built up by deposition (e.g., chemical vapor deposition (CVD)).

The exemplary intermediate layer 54 may serve principally as a bonding layer for good adherence of the outer layer 56. The intermediate layer may also provide a backup or additional barrier against oxygen. Exemplary intermediate layer materials are carbides or nitrides (e.g., titanium carbide) built up by deposition (e.g., CVD). Such materials are advantageously stable at outer layer deposition temperatures in the range of 1500–1600° C.

The exemplary base (and innermost) layer 52 may serve to at least temporarily secure the intermediate layer to the substrate while not adversely reacting with the substrate. Exemplary base layer materials comprise metals having a face centered cubic (FCC) structure (e.g., nickel or platinum) built up by electroplating. Such a lattice structure may have advantageous tolerance for incidental infiltration of carbon and/or nitrogen atoms during deposition of the intermediate layer without either catastrophic loss of structural integrity or substantial transmission of such atoms to the substrate. In the absence of such a base layer, in the elevated temperatures typical of CVD there would be substantial infiltration of the carbon and/or nitrogen into the substrate. This infiltration may be particularly problematic with body centered cubic (BCC) lattice structure typical of refractory metals. The infiltration may form an embrittled layer containing the carbide and/or nitride of the refractory metal. This embrittlement may serve as a source of cracks propagating through the coating layers.

The exemplary substrate 50 is formed, e.g., from sheet stock having a surface including a pair of opposed faces 57 and 58 with a thickness T between. Complex cooling features may be stamped, cut, or otherwise provided in the substrate 50. An interior surface 60 of the coating system and base layer 52 sits atop the exterior surface of the substrate 50 and an exterior surface 62 of the coating system and outer layer 54 provides an exterior surface of the RMC 38. The transitions between layers may be abrupt or may have compositional gradients. In the exemplary embodiment, the base layer 52 has an as-deposited thickness $T_2$, the intermediate layer 54 has a thickness $T_3$, and the outer layer 56 has a thickness $T_4$. Exemplary T is at least 50μ, more narrowly at least 100μ. Exemplary $T_2$ is 1–10 μ, more narrowly, 1–4μ, or 1–3μ. Exemplary $T_3$ is 0.5–5μ, more narrowly 1–4μ or 1–3μ. Exemplary $T_4$ is at least 4μ, more narrowly 5–25μ, or 15–25μ.

Figure 3:
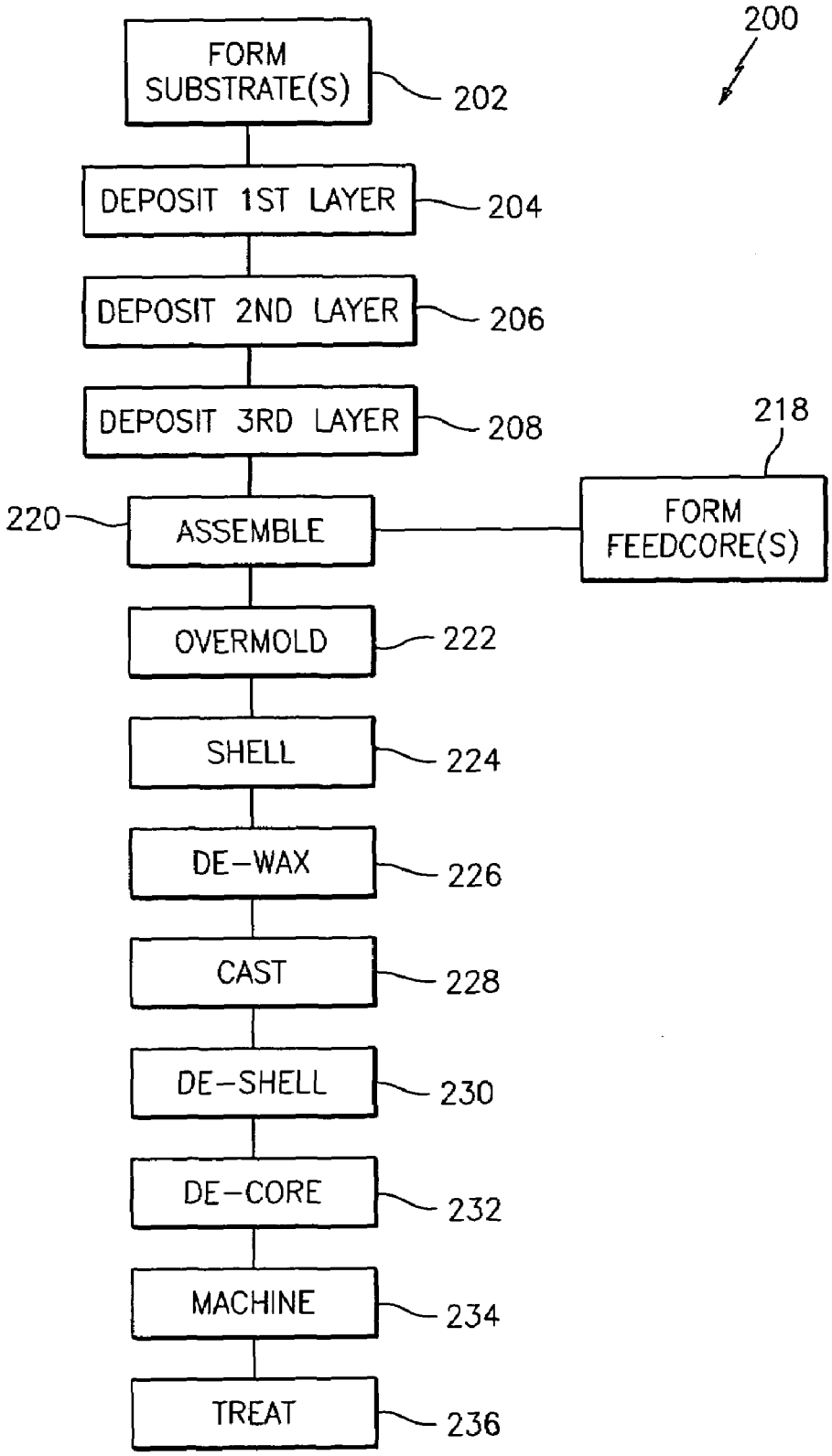
FIG. 3 is a flowchart of processes for forming and using the pattern of FIG. 1.

FIG. 3 shows an exemplary process 200 of manufacture and use (simplified for illustration) of the exemplary. The substrate(s) are formed 202 such as via stamping from sheet stock followed by subsequent bending or other forming to provide a relatively convoluted shape for casting the desired features. After any cleaning to remove residual oxides (e.g., acid and/or alkali wash followed by deionized water rinse), a first metal (e.g., essentially pure nickel) is applied 204 atop the substrate (e.g., by electroplating) to form the base layer 52.

After any further cleaning, one or more carbides and/or nitrides of one or more second metals (e.g., essentially pure titanium carbide, which is commercially available at low cost) is applied 206 (e.g., by CVD) to form the intermediate layer. At the elevated temperatures of the CVD process, at the inboard Mo/Ni boundary, there may be interdifussion, creating a region of Mo-Ni solid solution. Also, small amounts of carbon may diffuse into the nickel from the deposition vapor, especially at the beginning of the deposition process, before substantial titanium carbide accumulation. The ceramic barrier material (e.g., alumina) is applied 210 (e.g., also by CVD in the same chamber immediately after titanium carbide deposition) to form the outer layer 56. During the deposition of the outer layer 56, the interdiffusion of the Mo and Ni may continue. Advantageously essentially all the Ni is consumed. The resulting solid solution layer may have a relatively low nickel concentration (e.g., 2% or less at the outboard extreme). The absence of the Ni layer improves thermal performance because of the relatively low melting temperature of the Ni. Such diffusion of the Ni has not been completed at the end of deposition, it may be achieved by a postdeposition heating step. Alternatively or additionally, a predeposition heating step may give the diffusion a partial head start. Additional layers, treatments, and compositional/process variations are possible.

The RMC(s) are then assembled 220 to the feed core(s) or other core(s). Exemplary feed cores may be formed separately (e.g., by molding from silicon-based or other ceramic material) or formed as part of the assembling (e.g., by molding such feed core material partially over the RMC(s)). The assembling may also occur in the assembling of a die for overmolding 222 the core assembly with the wax-like material 26. The overmolding 222 forms a pattern which is then shelled 214 (e.g., via a multi-stage stuccoing process forming a silica-based shell). The wax-like material 26 is removed 216 (e.g., via steam autoclave). There may be additional mold preparation (e.g., trimming, firing, assembling). The firing may perform all or part of the postdeposition heating to ensure Mo-Ni interdiffusion noted above. A casting process 218 introduces one or more molten materials (e.g., for forming a superalloy based on one of more of Ni, Co, and Fe) and allows such materials to solidify. The shell is then removed 220 (e.g., via mechanical means). The core assembly is then removed 222 (e.g., via chemical means). The as-cast casting may then be machined 224 and subject to further treatment 226 (e.g., mechanical treatments, heat treatments, chemical treatments, and coating treatments).

The present system and methods may have one or more advantages over chromium-containing coatings. Notable is reduced toxicity. Chromium containing coatings are typically applied using solutions of hexvalent chromium, a particularly toxic ion. Furthermore, when the coated core is ultimately dissolved, some portion of the chromium will return to this toxic valency. The present coatings may have less than 0.2%, preferably less than 0.01% chromium by weight, and, most preferably, no detectable chromium.

One or more embodiments of the present invention have been described. Nevertheless, it will be understood that various modifications may be made without departing from the spirit and scope of the invention. For example, the coatings may be utilized in the manufacture of cores of existing or yet-developed configuration. The details of any such configuration may influence the details of any particular implementation as may the details of the particular ceramic core and shell materials and casting material and conditions. Accordingly, other embodiments are within the scope of the following claims.

What is claimed is:

1. An investment casting core comprising:

a refractory metal-based substrate;

a first layer consisting principally of a ceramic; and a second layer, located between the first layer and the substrate, consisting principally of one or more carbides and/or nitrides, wherein there is at least one of:

a third layer located between the second layer and the substrate and consisting in major part of one or more additional metals having an FCC lattice structure; and a solid solution surface layer of the substrate having a minor amount of said one or more additional metals.

2. The core of claim 1 wherein:

the ceramic consists essentially of at least one of alumina, mullite, magnesia, and silica;

the substrate is molybdenum-based.

3. The core of claim 1 wherein:

there is no said third layer; and the one or more additional metals consists essentially of nickel.

4. The core of claim 1 wherein:

the first layer consists essentially of aluminum oxide and the first thickness is a nominal first thickness.

5. The core of claim 1 wherein at a first location:

the first layer has a first thickness is at least 4.0μ;

the second layer has a second thickness of 1.0–4.0μ; and the substrate has a thickness in excess of 50μ.

6. The core of claim 1 being a first core in combination with:

a ceramic or refractory metal-based second core; and a hydrocarbon-based material in which the first core and the second core are at least partially embedded.

* * * * *